US008087183B2

(12) United States Patent
Prajescu et al.

(10) Patent No.: US 8,087,183 B2
(45) Date of Patent: Jan. 3, 2012

(54) CLOTHES DRYER DRUM BEARING ASSEMBLY

(75) Inventors: Gabriel Prajescu, Dollard-des-Ormeaux (CA); Dominique Larochelle, St-Bruno (CA)

(73) Assignee: Mabe Canada Inc., Burlington (CA)

( * ) Notice: Subject to any disclaimer, the term of this patent is extended or adjusted under 35 U.S.C. 154(b) by 812 days.

(21) Appl. No.: 12/222,627

(22) Filed: Aug. 13, 2008

(65) Prior Publication Data

US 2009/0083992 A1 Apr. 2, 2009

(30) Foreign Application Priority Data

Sep. 28, 2007 (CA) ..... 2604668

(51) Int. Cl.
*D06F 58/06* (2006.01)
*F26B 11/04* (2006.01)

(52) U.S. Cl. ..... 34/601

(58) Field of Classification Search ..... 34/601
See application file for complete search history.

(56) References Cited

U.S. PATENT DOCUMENTS

| | | | | |
|---|---|---|---|---|
| 3,399,464 A | | 9/1968 | Erickson et al. | |
| 4,586,269 A | | 5/1986 | St. Louis | |
| 4,754,556 A | | 7/1988 | Carr | |
| 5,216,823 A | | 6/1993 | Ripley | |
| 5,257,448 A | * | 11/1993 | Pearce et al. | 34/601 |
| 5,363,569 A | * | 11/1994 | Kadakia | 34/601 |
| 5,548,908 A | | 8/1996 | Torborg et al. | |

* cited by examiner

*Primary Examiner* — Jiping Lu

(57) ABSTRACT

A clothes dryer front bearing structure that fits within an open end of the dryer drum has wear resistant bearing glides attached to an upper arcuate wall portion without the use of an additional fastener. The upper arcuate wall portion has one or more pairs of spaced apart apertures that define between them a glide wall supporting portion. The bearing structure also has pairs of spaced apart curb walls for each pair of apertures that extend below the upper arcuate wall portion adjacent to the apertures. The bearing glide has an intermediate portion overlying the glide wall supporting portion for rotatably supporting the open end of the drum, and opposing end portions that each pass through a corresponding aperture for engagement with a corresponding curb wall to thereby limit longitudinal movement of the glide and restrain the opposing end portions of the glide in the apertures and within the curb walls.

17 Claims, 6 Drawing Sheets

CLOTHES DRYER DRUM BEARING ASSEMBLY

FIELD OF THE INVENTION

The present invention relates to a clothes dryer front bearing structure that fits within an open end of a dryer drum. More particularly the present invention relates to the attachment of wear resistant bearing glides to an upper bearing portion of the front bearing structure.

BACKGROUND TO THE PRESENT INVENTION

Various bearing structures have been used to support the rotating dryer drum within the cabinet of a dryer. Such support may take the form of a substantially axial shaft extending from the closed end of the drum and received in a suitable bearing. More generally there are bearings on both ends of the drum. In some cases roller bearings have been used at the open end of the drum on which an outside surface of the drum turns. In other cases, the bearing structure at the open end of the drum is mounted to the front panel of the dryer cabinet and provides a generally circular supporting ring that fits inside the open end of the drum. In some cases a felt material surrounds the generally circular supporting ring. In this case, the drum engages the felt material.

In one dryer bearing structure, the dryer bearing comprises upper and lower bearing structural portions fitted together and mounted to the front panel of the dryer cabinet by snapping hooks and/or screws. The two bearing structural portions provide a ring like bearing support surface and form the front bulkhead within the open end of the clothes dryer drum, including an opening for clothes to pass into the drum. The lower bearing structural portion comprises a series of air flow openings through which air exits from the drum. The lower bearing portion typically provides a recessed felt receiving groove extending about the ring like bearing support surface defined by the lower portion and into which the open end of the drum extends. The upper bearing structural portion has a pluarlity of wear resistant glides that are mounted to the ring like bearing support surface of the upper bearing structural portion. The glides carry most of the load of the dryer drum at the open end of the drum. The glides are typically rectangular in shape and have ends that fit into openings in the ring like bearing support surface of the upper bearing portion. At least one of the ends of the glide are held in place by a screw passing into an inside surface of the upper bearing structural portion. In the past, the dryer drums typically have rotated in one direction. For a drum that would be capable of rotating in opposing two directions, two screws, one at each end of the glide may be required. The use of these screws to hold the bearing glides in place is assembly labour intensive and there would be an advantage in cost of dryer manufacture to eliminate these screws.

BRIEF DESCRIPTION OF THE INVENTION

The present invention relates to a clothes dryer front bearing structure that fits within an open end of a dryer drum and more particularly to the attachment of wear resistant bearing glides to an upper arcuate wall portion of the front bearing structure without the use of an additional fastener.

The upper arcuate wall portion has one or more pairs of spaced apart apertures that have a first predetermined arc span between them that defines a glide wall supporting portion. The bearing structure also has a pair of spaced apart curb walls for each pair of apertures. The curb walls extend below the upper arcuate wall portion adjacent to the apertures. The curb walls have a second predetermined arc span between them at the upper arcuate wall portion that is greater than the first predetermined arc span of the apertures. The structure has an elongated wear resistant bearing glide for each pair of spaced apart apertures. The bearing glide comprises an intermediate portion overlying the glide wall supporting portion for rotatably supporting the open end of the drum, and opposing end portions that each pass through a corresponding aperture for engagement with a corresponding curb wall. The curb walls limit longitudinal movement of the bearing glide and restrain the opposing end portions of the bearing glide in the apertures and within the curb walls. Advantage is found in that no additional fasteners, such as screws, are required to secure or hold the bearing glide in place.

The pair of curb walls may each comprise, in one embodiment, a confronting portion that extends inwardly towards the other curb wall and beneath the aperture adjacent thereto to form a receiving pocket in which one of the opposing end portions of the elongated wear resistant bearing glide is captured. In another embodiment, each of the pair of curb walls comprises a first wall portion that extends generally perpendicular away from the inside surface of the upper arcuate wall portion, and the confronting portions comprise a flange that extends generally perpendicular to the first wall portion.

In one embodiment, the upper arcuate wall portion further comprises a tab that extends from the glide wall supporting portion for the upper arcuate wall portion partially into one aperture of the pair of apertures. In this embodiment, the elongated wear resistant bearing glide has a glide aperture at its junction between one of its opposing end portions and the intermediate portion that fits over the tab. This feature facilitates assembly because the end of the glide having the glide aperture may be first inserted into the arcuate wall aperture and over the tab. Next, the glide is temporarily deformed and the other end thereof sprung through the other arcuate wall aperture.

The elongated bearing glide may comprise any suitable bearing structure. In one embodiment, both nylon glides and polytetrafluoroethylene material glides are used for their wear and lower friction characteristics. The polytetrafluoroethylene glides are produced by Dewal Industries as part number 540B387P002. The polytetrafluoroethylene material glides are located in an uppermost portion of the bearing structure to carry a good portion of the load associated with the open end of the dryer drum. In this embodiment, the wear resistant bearing glide is generally rectangular in shape and the pair of spaced apart apertures are slotted apertures having a width greater than the width of the wear resistant bearing glide. The bearing glide has a deflected length that is greater than the first predetermined arc span of the apertures and, preferably, that is less than or equal to the second predetermined arc span between the curb walls.

In accordance with an embodiment of the invention there is provided a clothes dryer comprising a dryer drum having an open end, a front panel, and a bearing structure for fitting into and rotatably supporting the open end of the dryer drum relative to the front panel. The bearing structure comprises a generally cylindrical support wall for fitting into the open end of the dryer drum. The support wall comprises an upper arcuate wall portion. The upper arcuate wall portion has inside and outside surfaces. The bearing structure further comprises at least one pair of spaced apart apertures passing through the upper arcuate wall portion. The spaced apart pair of apertures have a first predetermined arc span between them that defines a glide wall supporting portion for the upper arcuate wall portion. The bearing structure comprises a pair of spaced apart curb walls, one for each pair of spaced apart apertures, extending from the inside surface of the upper arcuate wall portion adjacent to and below the apertures. The pair of curb walls have a second predetermined arc span between them at the inside surface of the upper arcuate wall portion that is greater than the first predetermined arc span of the pair of spaced apart apertures. The bearing structure further comprises an elongated wear resistant bearing glide for each pair of spaced apart apertures. The bearing glide comprises an intermediate portion overlying the glide wall supporting portion for rotatably supporting the open end of the drum. The bearing glide comprises opposing end portions each of which pass through a corresponding aperture of the pair of apertures for engagement with a corresponding curb wall of the pair of curb walls to thereby limit longitudinal movement of the bearing glide and restrain the opposing end portions of the bearing glide in the apertures and within the curb walls without the use of an additional fastener.

BRIEF DESCRIPTION OF THE DRAWINGS

For a better understanding of the nature and objects of the present invention reference may be had by way of example to the accompanying diagrammatic drawings in which.

DETAILED DESCRIPTION OF THE INVENTION

The present invention relates to a clothes dryer front bearing structure that fits within an open end of a dryer drum. More particularly, the present invention relates to the attachment of wear resistant bearing glides to an upper bearing portion of the front bearing structure.

Figure 1:
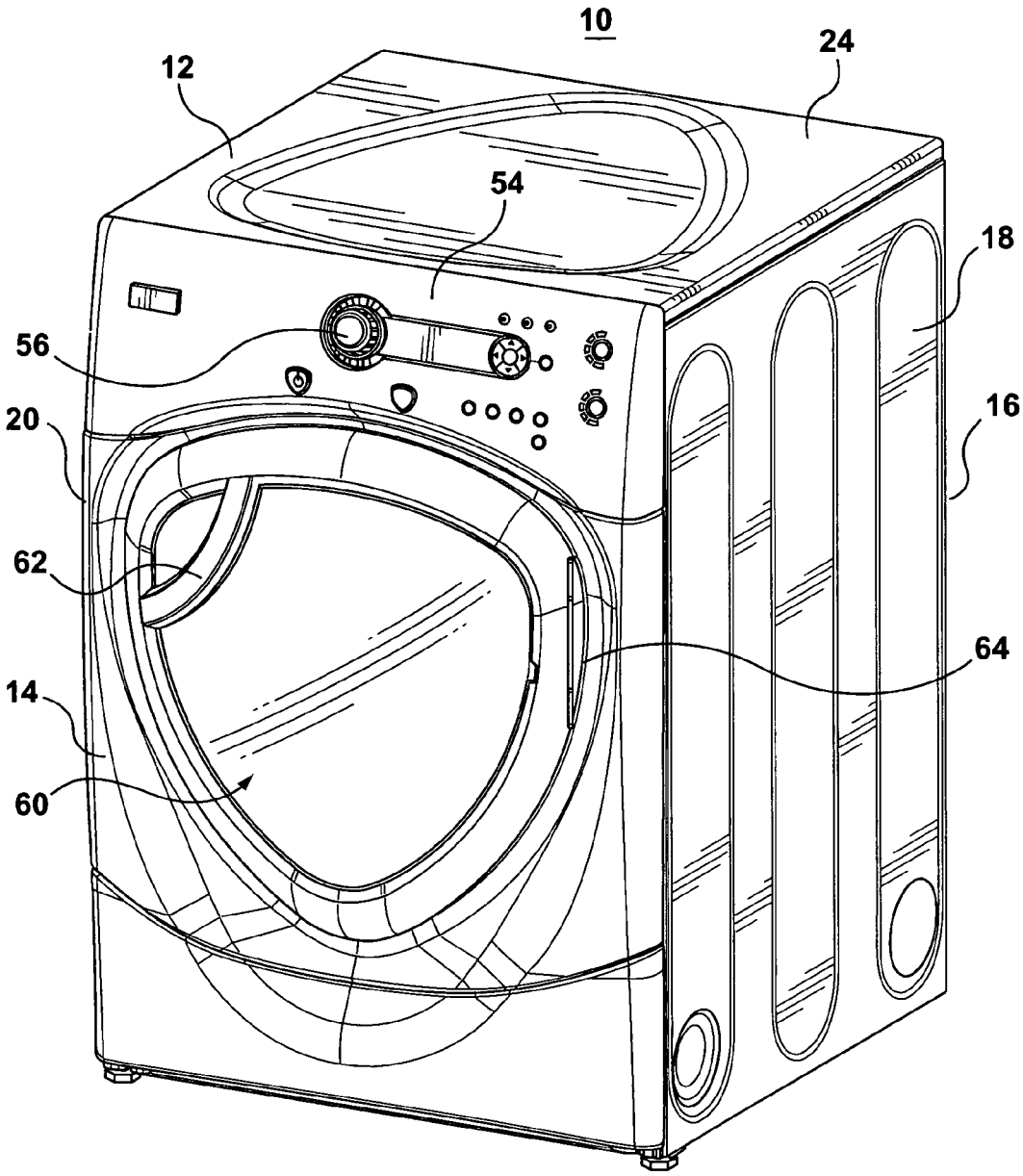
FIG. 1 is a perspective view of an exemplary clothes dryer that may benefit from the present invention.
Figure 2:
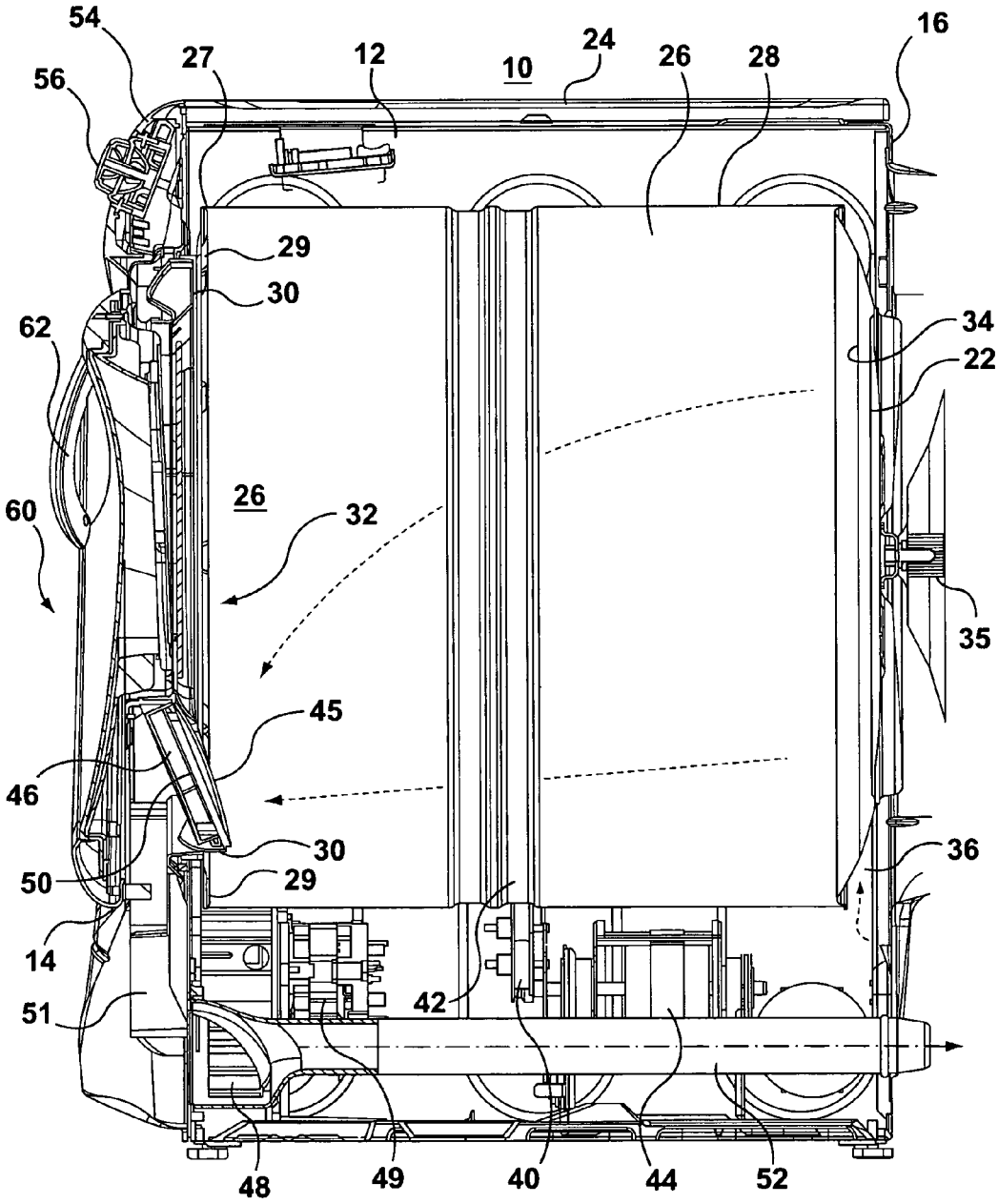
FIG. 2 is a side sectional view of an exemplary clothes dryer that may benefit from the present invention.

FIGS. 1 and 2 show perspective and side sectional views of an exemplary clothes dryer 10 that may benefit from the present invention. The clothes dryer 10 includes a cabinet or a main housing 12 having a front panel 14, a rear panel 16, a pair of side panels 18 and 20 spaced apart from each other by the front and rear panels, and a top cover 24. Within the housing 12 is a drum or container 26 mounted for rotation around a substantially horizontal axis. A motor 44 rotates the drum 26 about the horizontal axis through, for example, a pulley 40 and a belt 42. The drum 26 is generally cylindrical in shape, has an imperforate outer cylindrical wall 28, and has an open end 27 that typically comprises a metal ring 29 attached by welding to the drum 26 for reducing the diameter of the opening of the drum 26 to match a front bulkhead wall or front bearing 30. The bearing 30 further defines an opening 32 into the drum 26. Clothing articles and other fabrics are loaded into the drum 26 through the opening 32. A plurality of tumbling ribs (not shown) are provided within the drum 26 to lift the articles and then allow them to tumble back to the bottom of the drum as the drum rotates. The drum 26 includes a rear wall 34 rotatably supported within the main housing 12 by a suitable fixed bearing 35. The rear wall 34 includes a plurality of holes (not shown) that receive hot air that has been heated by a heater such as electrical heating elements (not shown) in the heater housing 22. The housing 22 receives ambient air via an inlet 36. Although the exemplary clothes dryer 10 shown in FIG. 1 is an electric dryer, it could just as well be a gas dryer having a gas burner.

After the clothing articles have been dried, they are removed from the drum 26 via the opening 32. The dryer has a control panel 54 with touch and or dial controls 56 whereby a user can control the operation of the dryer. Clothes are inserted into, and removed from, the drum 26 through opening 32. Opening 32 is shown closed by a window or port-hole like door 60. Door 60 has a handle 62 for pivotally opening the door about hinge 64.

Heated air is drawn from the drum 26 by a blower fan 48 which is also driven by a second motor 49 in the embodiment shown. In an alternative embodiment, motor 44 could be used to drive blower fan 48. The air passes through a grill 45 and screen filter 46. Grill 45 keeps clothing articles tumbling in the drum 26 from contacting the filter 46 and touching the lint trapped by the filter 46 within the trap duct 50. As the air passes through the screen filter 46, it flows through lower duct portion 51 and is drawn by blower wheel 48 attached to motor 49 out of the clothes dryer through an exhaust duct 52. In this embodiment, the drum 26 is in air flow communication with the trap duct 50 whose lower duct portion 51 has an outlet that is in air flow communication with the blower wheel 48 and the exhaust duct 52.

Figure 3:
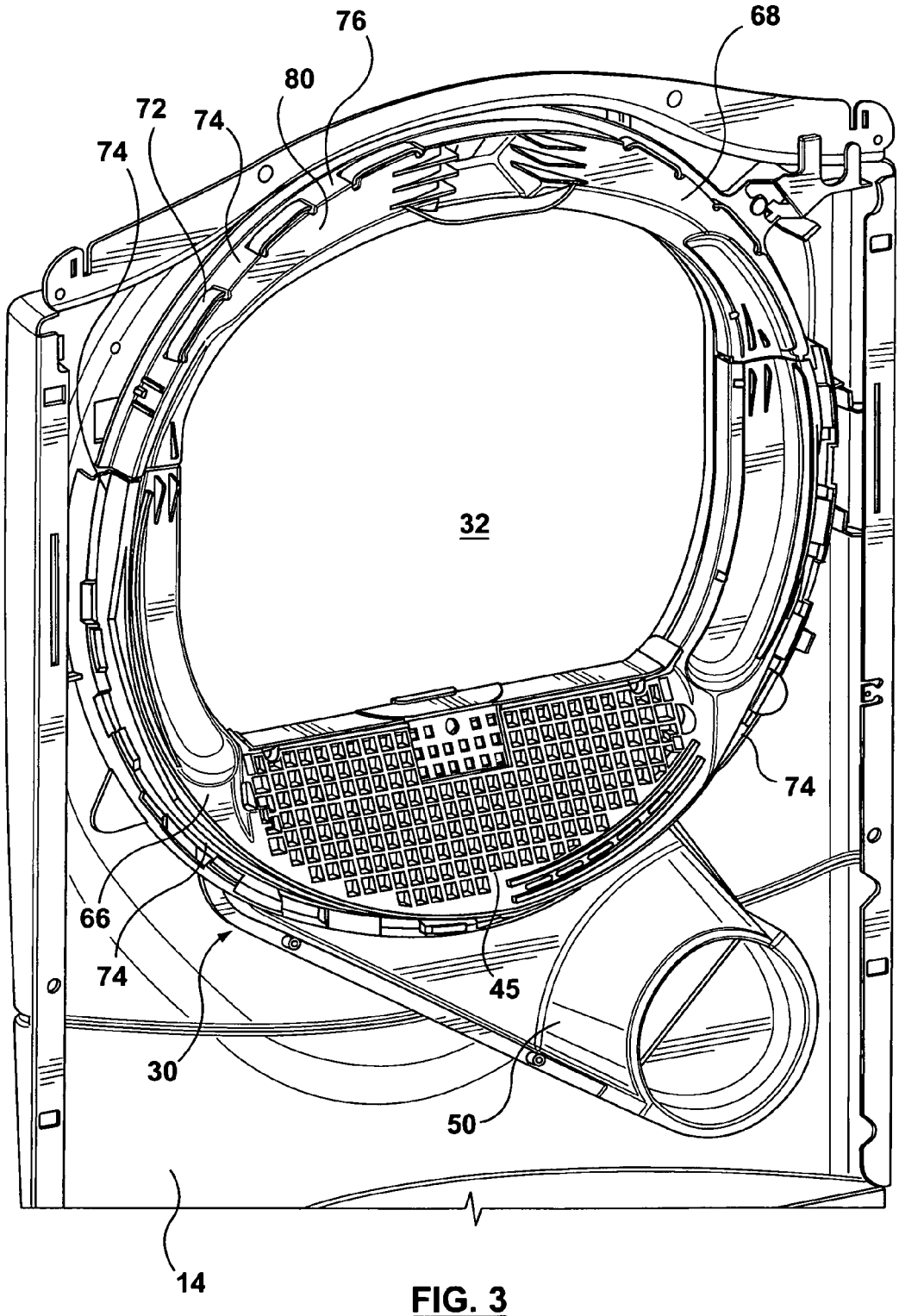
FIG. 3 is a perspective inside view showing the bearing structure mounted to the front panel of the clothes dryer.
Figure 5:
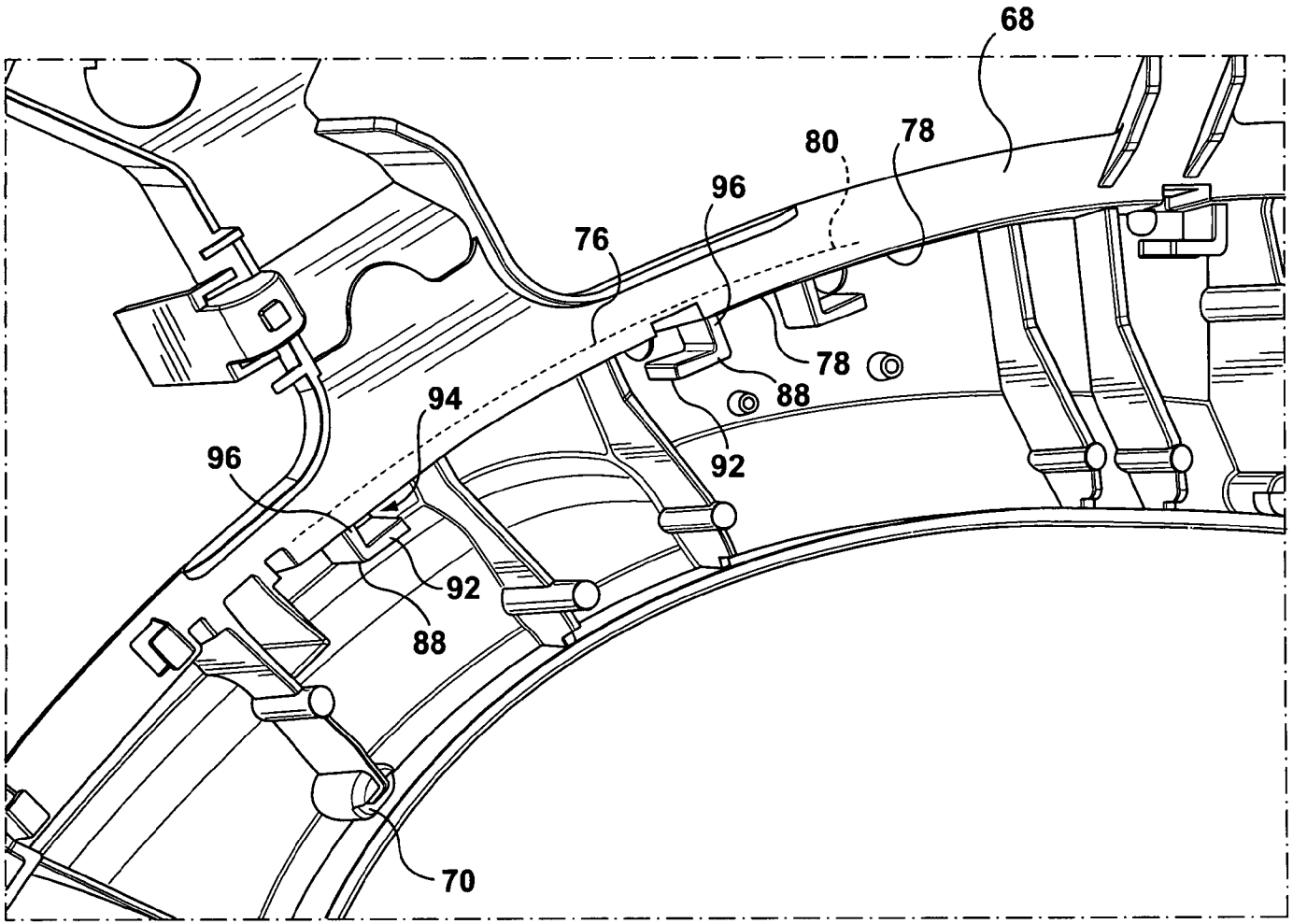
FIG. 5 is an enlarged perspective view showing an inside view of the upper portion of the bearing support structure; and, FIG. 6 is a sectional view taken through lines VI-VI of FIG. 4.

Referring to FIG. 3, it can be seen that the front bulkhead structure or front bearing structure 30 comprises a lower bearing structural portion 66 and an upper bearing structural portion 68. These two portions 66, 68 are formed from a mold of plastic material and are connected together and then subsequently fastened to the front panel 14 by suitable snapping hooks 70 (FIG. 5) and screws (not shown). The front bearing structure 30 has multiple purposes within this dryer. One purpose is to act as a bearing structure for the open end 27 of the drum 26. The upper bearing portion 68 and lower bearing portion 66 together define a generally cylindrical support wall 74 that fits into the open end 27 of the dryer drum 26 and around which the open end 27 of the drum 26 rotates. Another function is to provide a front bulkhead wall with an opening that faces into the dryer drum 26. However, the present invention is directed primarily to the upper portion 26 of the front bearing structure 30.

Referring now to FIGS. 3 through 6, the attachment of the elongated wear resistant bearing glides 72 to the bearing structure is described. The bearing glides 72 carry most of the load of the open end 27 of dryer drum 26 as the open end 27 rotates in engaging relation over the bearing glides 72. In the embodiment shown, five elongated wear resistant bearing glides 72 are spaced about an upper portion of the cylindrical support wall 74 and are mounted to the upper bearing portion 68. The upper bearing portion 68 comprises an arcuate wall portion 76 that forms part of the cylindrical support wall 74. The upper arcuate wall portion 76 has inside and outside surfaces respectively 78 and 80. The glides 72 preferably comprise both nylon glides and polytetrafluoroethylene material glides for their wear and lower friction characteristics. The polytetrafluoroethylene glides are those made by Dewal Industries under part number 540B387P002. The polytetrafluoroethylene glides are located in an uppermost portion of the bearing structure to carry a good portion of the load associated with the open end of the dryer drum while the lower glides are nylon.

For each wear resistant bearing glide 72 utilized, there are a pair of spaced apart slotted apertures 82 that pass through the upper arcuate wall portion 76 and have a first predetermined arc span 84 between them that defines a glide wall supporting portion 86 for the upper arcuate wall portion 76. As seen on the inside view in FIG. 5 and the sectional view in FIG. 6, there are a pair of spaced apart curb walls 88, one for each of the spaced apart apertures 82, that extend from the inside surface 78 of the upper arcuate wall portion adjacent to and below the apertures 82. The pair of curb walls 88 have a second predetermined arc span 90 between them at the inside surface 78 of the upper arcuate wall portion 76. This second predetermined arc span 90 is greater than the first predetermined arc span 84 of the pair of spaced apart apertures 82. Each of the curbed walls 88 comprises a confronting portion 92 that extends inwardly towards the other curbed wall 88 and beneath the slotted aperture 82 adjacent thereto to form a receiving pocket 94. The confronting end portion 92 typically comprises a flange that extends generally perpendicular to a first wall portion 96 that extends generally perpendicular away from the inside surface 78 of the upper arcuate wall portion 76. The upper arcuate wall portion 76 also comprises a tab 98 that extends from the glide wall supporting portion 86 of the upper arcuate wall portion 76 partially into one aperture of the pair of apertures 82.

Figure 4:
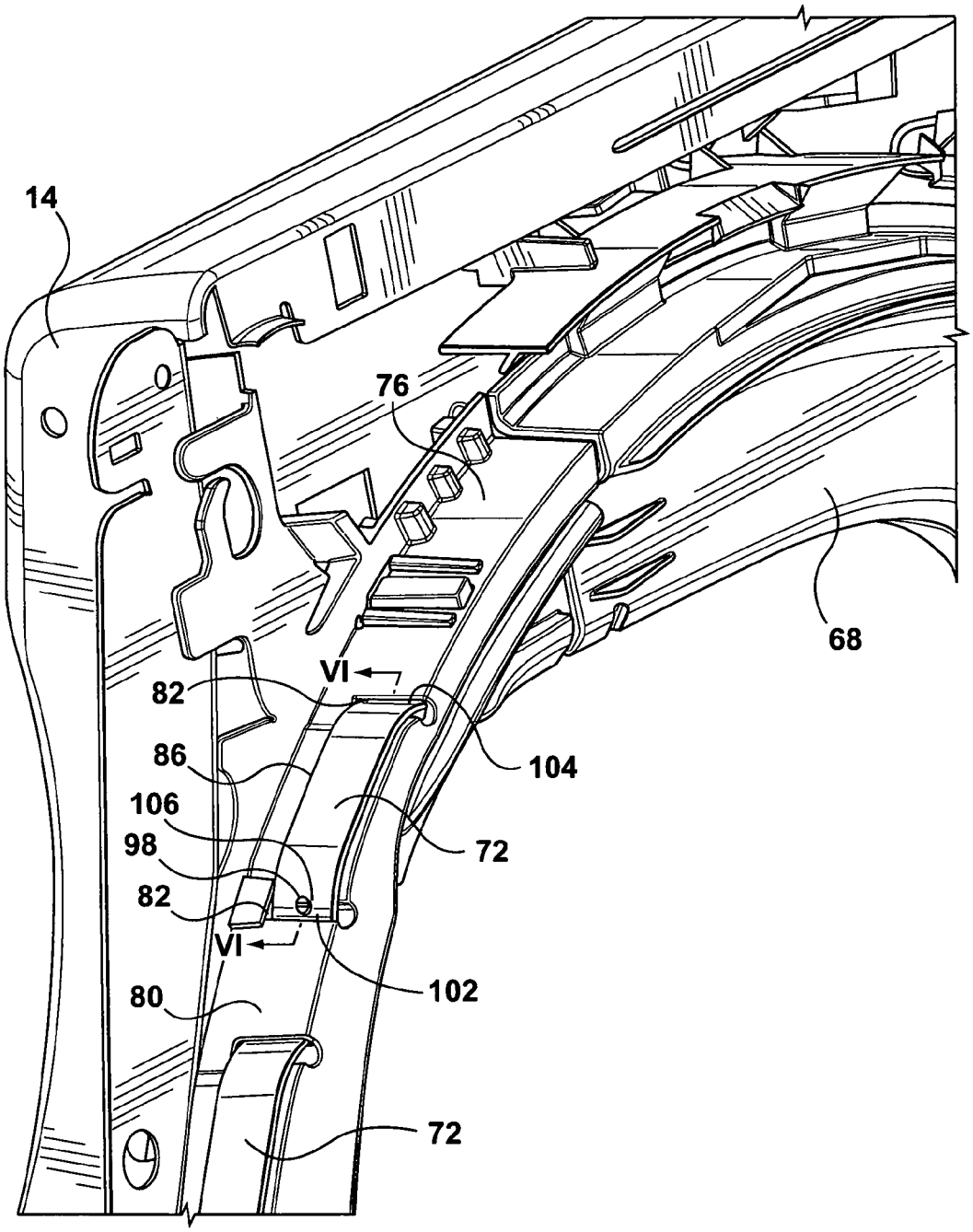
FIG. 4 is an enlarged perspective view showing an upper portion of the bearing support structure.
Figure 6:
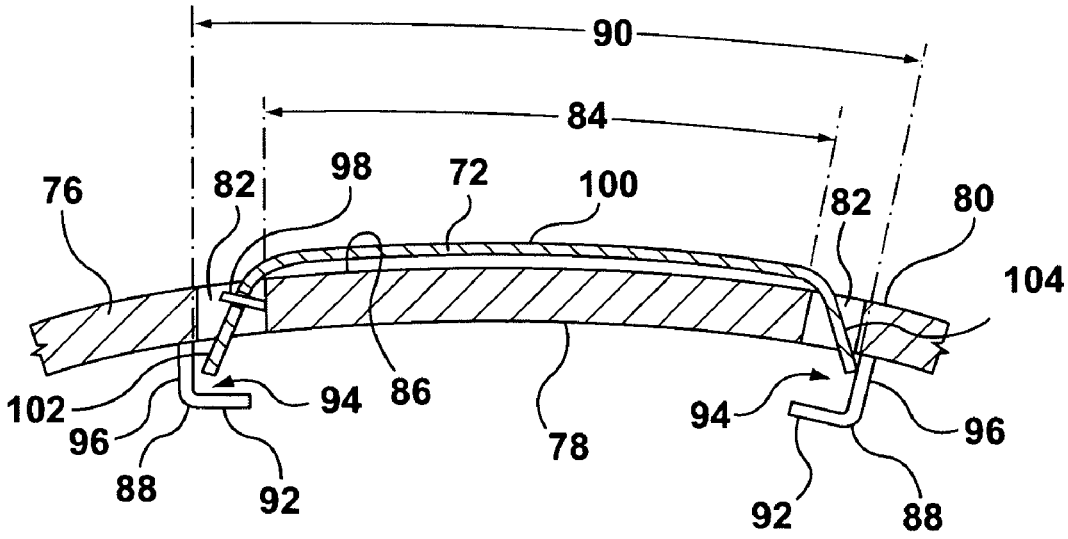

The elongated wear resistant bearing glides 72 each comprises an intermediate portion 100 overlying the glide wall supporting portion 86 for rotatively supporting the open end 27 of the drum 26. The bearing glide 72 has opposing ends 102 and 104 that each pass through a corresponding aperture 82 for engagement with a corresponding curb wall 88. The curb wall 88 limits longitudinal movement of the glide 72 and restrains the opposing ends 102, 104 of the bearing glide 72 without the use of additional fasteners. In effect the curb wall 88 with its confronting portion 92 captures the opposing end portions 102, 104 of the elongated wear resistant bearing glide 72 in the receiving pocket 94. The elongated resistant bearing glide 72 has an aperture 106 (FIG. 4) at its junction between opposing end portion 102 and the intermediate portion 100. This glide aperture 106 fits over the tab 98 as shown in FIGS. 4 and 6. The wear resistant bearing glide 72 is generally rectangular in shape and has a width and a length. The pair of spaced apart apertures 82 are slotted apertures having a width greater than the width of the wear resistant bearing glide as seen in FIG. 4. The bearing glide 72 has a deflected length that is greater than the first predetermined arc span 84 between the spaced apart apertures 82 and less than the second predetermined arc span 90 between the curbed walls 88 as shown in FIG. 6. By deflected it is meant the length of the bearing glide 72 when its opposing ends 102, 104 are bent to pass through the slotted apertures 82 and be received in pockets 94.

The wear resistant glide 72 may be readily inserted into the slotted apertures 82 by first placing opposing end 102 into a first slotted aperture 82 and then placing the aperture 100 of the wear resistant glide 72 over the tab 98. Next, the other end 104 of the wear resistant glide 72 may be inserted into the other slotted aperture 82. In so doing the glide can be sprung into place with its ends captured by the receiving pockets 94 of the curb walls 88 without the use of additional mechanical fasteners.

While the invention has been described in terms of various specific embodiments, those skilled in the art will recognize that the invention can be practiced with modifications within the spirit and scope of the present invention as disclosed herein.

What is claimed is:

1. A clothes dryer comprising a dryer drum having an open end, a front panel, and a bearing structure for fitting into and rotatably supporting the open end of the dryer drum relative to the front panel, the bearing structure comprising:

a generally cylindrical support wall for fitting into the open end of the dryer drum, the support wall comprising an upper arcuate wall portion and the upper arcuate wall portion having inside and outside surfaces;

at least one pair of spaced apart apertures passing through the upper arcuate wall portion having a first predetermined arc span between them that defines a glide wall supporting portion for the upper arcuate wall portion;

a pair of spaced apart curb walls, one for each pair of spaced apart apertures, extending from the inside surface of the upper arcuate wall portion adjacent to and below the apertures, the pair of curb walls having a second predetermined arc span between them at the inside surface of the upper arcuate wall portion greater than the first predetermined arc span of the pair of spaced apart apertures;

an elongated wear resistant bearing glide for each pair of spaced apart apertures, the bearing glide comprising an intermediate portion, overlying the glide wall supporting portion for rotatably supporting the open end of the drum, and opposing end portions that each pass through a corresponding aperture of the pair of apertures for engagement with a corresponding curb wall of the pair of curb walls to thereby limit longitudinal movement of the bearing glide and restrain the opposing end portions of the bearing glide in the apertures and within the curb walls without the use of an additional fastener.

2. The clothes dryer of claim 1 wherein each of the pair of curb walls comprises a confronting portion that extends inwardly towards the other curb wall and beneath the aperture adjacent thereto to form a receiving pocket in which one of the opposing end portions of the elongated wear resistant bearing glide is captured.

3. The clothes dryer of claim 2 wherein each of the pair of curb walls comprises a first wall portion that extends generally perpendicular away from the inside surface of the upper arcuate wall portion, and the confronting portion comprises a flange that extends generally perpendicular to the first wall portion.

4. The clothes dryer of claim 3 wherein the upper arcuate wall portion comprises a tab that extends from the glide wall supporting portion for the upper arcuate wall portion partially into one aperture of the pair of apertures, and the elongated wear resistant bearing glide has a glide aperture at its junction between one of its opposing end portions and the intermediate portion that fits over the tab.

5. The clothes dryer of claim 4 wherein the wear resistant bearing glide is generally rectangular in shape having a width, and the pair of spaced apart apertures are slotted apertures having a width greater than the width of the wear resistant bearing glide.

6. The clothes dryer of claim 5 wherein the bearing glide has a deflected length that is greater than the first predetermined arc span between the spaced apart apertures and that is less than, or equal to, the second predetermined arc span between the curb walls.

7. The clothes dryer of claim 3 wherein the wear resistant bearing glide is generally rectangular in shape having a width, and the pair of spaced apart apertures are slotted apertures having a width greater than the width of the wear resistant bearing glide.

8. The clothes dryer of claim 3 wherein the bearing glide has a deflected length that is greater than the first predetermined arc span between the spaced apart apertures and that is less than, or equal to, the second predetermined arc span between the curb walls.

9. The clothes dryer of claim 2 wherein the upper arcuate wall portion comprises a tab that extends from the glide wall supporting portion for the upper arcuate wall portion partially into one aperture of the pair of apertures, and the elongated wear resistant bearing glide has a glide aperture at its junction between one of its opposing end portions and the intermediate portion that fits over the tab.

10. The clothes dryer of claim 2 wherein the wear resistant bearing glide is generally rectangular in shape having a width, and the pair of spaced apart apertures are slotted apertures having a width greater than the width of the wear resistant bearing glide.

11. The clothes dryer of claim 2 wherein the bearing glide has a deflected length that is greater than the first predetermined arc span between the spaced apart apertures and that is less than, or equal to, the second predetermined arc span between the curb walls.

12. The clothes dryer of claim 1 wherein the upper arcuate wall portion comprises a tab that extends from the glide wall supporting portion for the upper arcuate wall portion partially into one aperture of the pair of apertures, and the elongated wear resistant bearing glide has a glide aperture at its junction between one of its opposing end portions and the intermediate portion that fits over the tab.

13. The clothes dryer of claim 12 wherein the wear resistant bearing glide is generally rectangular in shape having a width, and the pair of spaced apart apertures are slotted apertures having a width greater than the width of the wear resistant bearing glide.

14. The clothes dryer of claim 12 wherein the bearing glide has a deflected length that is greater than the first predetermined arc span between the spaced apart apertures and that is less than, or equal to, the second predetermined arc span between the curb walls.

15. The clothes dryer of claim 1 wherein the elongated wear resistant bearing glide comprises one of a nylon and a polytetrafluoroethylene material.

16. The clothes dryer of claim 1 wherein the wear resistant bearing glide is generally rectangular in shape having a width, and the pair of spaced apart apertures are slotted apertures having a width greater than the width of the wear resistant bearing glide.

17. The clothes dryer of claim 1 wherein the bearing glide has a deflected length that is greater than the first predetermined arc span between the spaced apart apertures and that is less than, or equal to, the second predetermined arc span between the curb walls.

* * * * *